US006932267B2

(12) United States Patent
Potenza, Jr. et al.

(10) Patent No.: US 6,932,267 B2
(45) Date of Patent: Aug. 23, 2005

(54) PIZZA DELIVERY BOX

(76) Inventors: Louis F. Potenza, Jr., 128 Hampton Vista Dr., Manorville, NY (US) 11949; Lisa A. Pieroni, 60 Gard Ave., Bronxville, NY (US) 10708

( * ) Notice: Subject to any disclaimer, the term of this patent is extended or adjusted under 35 U.S.C. 154(b) by 0 days.

(21) Appl. No.: 10/703,044

(22) Filed: Nov. 6, 2003

(65) Prior Publication Data

US 2004/0094436 A1 May 20, 2004

Related U.S. Application Data

(60) Provisional application No. 60/424,622, filed on Nov. 7, 2002.

(51) Int. Cl.[7] ..... B65D 5/50

(52) U.S. Cl. ..... 229/199; 206/204; 229/906

(58) Field of Search ..... 229/199, 906; 206/204; 426/115, 124, 128; 108/25, 26, 50.11, 150; 248/146, 152, 683

(56) References Cited

U.S. PATENT DOCUMENTS

| | | | | | |
|---|---|---|---|---|---|
| 2,994,404 | A | * | 8/1961 | Schifferly | 206/204 |
| 3,721,803 | A | * | 3/1973 | DiStefano | 206/216 |
| 3,722,188 | A | * | 3/1973 | Cullen | 426/124 |
| 4,922,626 | A | * | 5/1990 | Fiddler | 34/80 |
| 5,002,221 | A | * | 3/1991 | Ragan | 229/906 |
| 5,077,050 | A | * | 12/1991 | Wall | 426/124 |
| 5,224,975 | A | * | 7/1993 | Purnell et al. | 96/108 |
| 5,404,808 | A | * | 4/1995 | Smith et al. | 99/483 |
| 5,509,601 | A | * | 4/1996 | Drabick | 229/199 |
| 5,698,217 | A | * | 12/1997 | Wilking | 206/204 |
| 5,887,783 | A | * | 3/1999 | Prokopis | 229/199 |
| 6,135,273 | A | * | 10/2000 | Cuen | 206/204 |

* cited by examiner

*Primary Examiner*—Gary E. Elkins
(74) *Attorney, Agent, or Firm*—Kirschstein, et al.

(57) ABSTRACT

A desiccant container is positioned within a box for delivering a pizza to absorb moisture and resist the crust from getting soggy, or the box from getting soaked with moisture, in order to deliver the pizza with a delicious taste and texture.

5 Claims, 1 Drawing Sheet

FIG. 1
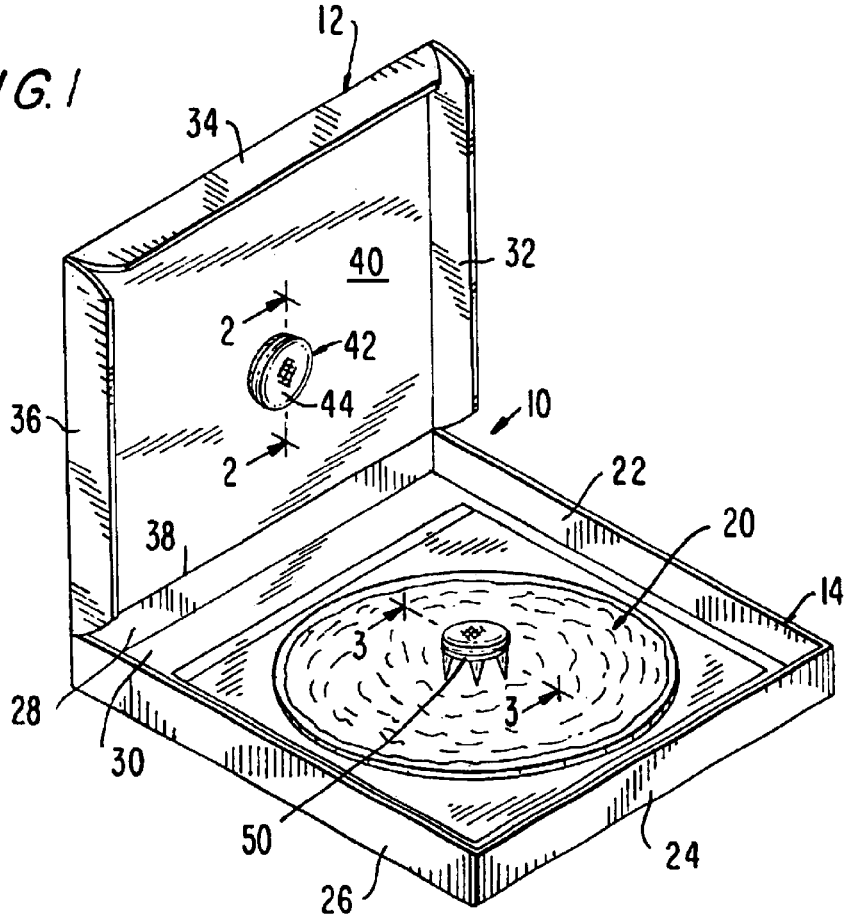
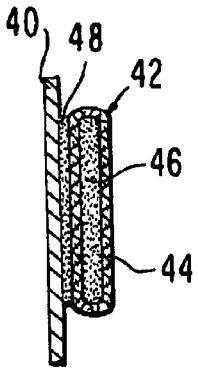
FIG. 2
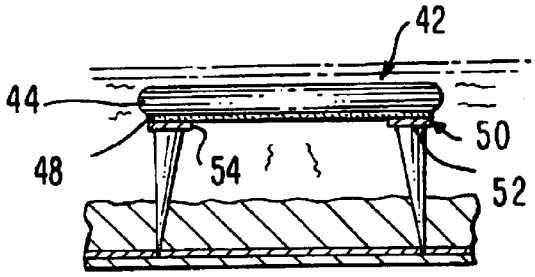
FIG. 3

PIZZA DELIVERY BOX

CROSS REFERENCE TO RELATED APPLICATIONS

This application claims the benefit of U.S. Provisional Patent Application Ser. No. 60/424,622, filed Nov. 7, 2002.

BACKGROUND OF THE INVENTION

1. Field of the Invention

The present invention generally relates to a box for delivering an oven-heated pizza with a taste and texture conforming to its state when the pizza was freshly prepared and removed from the oven.

2. Description of the Related Art

A pizzeria bakes a flat piece of dough topped with a tomato sauce and cheese, and often with other toppings, in an oven to make a pizza with a crisp, dry crust. Although the taste and texture of the pizza are optimum and best enjoyed when the freshly prepared pizza is eaten at the pizzeria, the pizza is often eaten off-premises at a consumer's home or office by being delivered in an individual paperboard box carried by a delivery person, often in an automobile to expedite the delivery.

The tomato sauce, as well as certain toppings, have an inherent high moisture content which is partially driven out during baking, but which continues to be emitted even after removal from the oven due to the high heat contained in the pizza. This emitted moisture becomes trapped in the box which is closed during delivery.

The trapped moisture is absorbed at least in part by the crust which, over time, tends to become soggy. The trapped moisture is also absorbed by the walls of the box, especially the bottom wall on which the pizza is placed. The bottom wall becomes, over time, soaked with the moisture, and loses its structural rigidity and also causes the pizza to stick to the bottom wall, thereby imparting an odd "cardboard" taste to the pizza.

Attempts have been made in the prior art to deliver a pizza without a soggy crust, without an odd taste, and without soaked boxes. Such attempts have included shortening the delivery time by racing the delivery automobile to its destination, providing vents in the delivery box to allow some of the trapped moisture to escape, providing a special compartment in the delivery automobile equipped with air blowers and ducts for circulating heated air around the box, and providing a special pouch in which the box is contained, again for maintaining the pizza warm, just to mention the attention paid to this delivery problem.

Experience has shown, however, that such attempts have been less than satisfactory. The more comprehensive attempts are beyond the means of the local pizza parlor and, even for the major pizza chains with greater financial resources, the pizza often arrives, just as before, with an undesirable taste and texture which detracts from its appeal.

SUMMARY OF THE INVENTION

Objects of the Invention

Accordingly, one object of this invention is to deliver a pizza with a taste and texture conforming to those of a freshly prepared pizza when initially removed from the oven.

Another object of this invention is to deliver a pizza without a soggy crust and odd taste.

Still another object of this invention is to deliver a pizza in an unsoaked box.

Yet another object of this invention is to enable a pizzeria, even of modest financial means, to convert a plain, paperboard box into one suitable for delivering a delicious pizza.

FEATURES OF THE INVENTION

In keeping with these objects and others which will become apparent hereinafter, one feature of this invention, briefly stated, resides in a moisture-trapping device comprising a container, a desiccant within the container, and means for positioning the container within a box for delivering a pizza. The container enables moisture to pass therethrough and be absorbed by the desiccant for removal. The desiccant can be, for example, montmorillonite clay, silica gel, synthetic zeolite, calcium sulfate, or calcium oxide. Silica gel is preferred because it is stable, non-corrosive and non-toxic. The desiccant is preferably renewable by baking.

The desiccant container is positioned within the box in several ways. For example, a double-sided adhesive tape can be used to adhere the container anywhere within the box, preferably on the lid or cover, or in one or more corners of the box. A peel-off protective layer is removable from the tape prior to affixing the container in the box.

Another embodiment involves adhering the desiccant container on a pizza accessory known as a tripod. The tripod has legs inserted into the center of the pizza and a raised abutment which prevents the lid from collapsing onto the upper surface of the pizza. The desiccant container is optimally positioned to entrap moisture emitted by the pizza.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a perspective view of an opened delivery box with a pizza therein, and equipped with moisture-trapping devices in accordance with this invention;

FIG. 2 is an enlarged sectional view taken on line 2—2 of FIG. 1; and FIG. 3 is an enlarged sectional view taken on line 3—3 of FIG. 1.

DETAILED DESCRIPTION OF THE PREFERRED EMBODIMENTS

Reference numeral 10 generally identifies a paperboard box for delivering a pizza 20 and includes a lid or cover 12 hinged to a tray 14. The tray 14 has upstanding walls 22, 24, 26, 28 and a bottom wall 30 on which the pizza 20 is placed. The lid 12 has flaps 32, 34, 36 and is folded about the fold line 38. The flaps are positioned inside of the walls 22, 24, 26, respectively. The lid has a top wall 40 overlying the bottom wall 30 in the closed position of the box.

Omitted from FIG. 1 for the sake of clarity are cutouts in the box which vent the interior. Also, the walls 22, 24, 26 are typically not of one-piece as shown, but are folded into the positions shown by cooperating projections and slits formed at the corners between the walls 22, 26 and the wall 24. As described so far, the box 10 is entirely conventional.

In accordance with this invention, a moisture-trapping device 42 is positioned within the box. The device includes a container 44 (see FIG. 2), a desiccant 46 within the container, and an adhesive 48 for adhering the container 44 inside the box. As shown in FIG. 2, the container 44 is adhered to a central area of the top wall 40 at an elevated position above the pizza. As shown in FIG. 3, the container 44 is adhered to a raised abutment ring 52 of a tripod 50 which is an accessory having three legs connected to the abutment ring 52 and conventionally used to prevent the top wall 40 from collapsing into the pizza. The ring 52 has a large central opening 54 so that the container is adhered on an annulus bounding the opening.

The desiccant can be, for example, montmorillonite clay, silica gel, synthetic zeolite, calcium sulfate, or calcium oxide. Silica gel is preferred because it is stable, non-corrosive and non-toxic. The desiccant is preferably renewable by baking.

The container 44 is porous to enable the moisture emitted by the pizza to pass and be absorbed by the desiccant. The overhead placement of the device 42 above the pizza, as well as the central opening 54, enables the moisture to unobstructedly pass to and through the container for entrapment by the desiccant.

The device can be placed anywhere within the box and not merely on the top wall 40. For example, the rear wall 28 is a convenient area at which to locate the device.

The adhesive 48 is preferably a double-sided tape having a peelable protective strip for covering the adhesive. Once peeled away to expose the adhesive underneath the strip, the device can simply be pressed onto the desired position in the box. The positioning of the device can be easily performed by pizzeria staff or, if desired, can be done at the factory where the boxes are produced by the manufacturer.

When the device is incorporated in the tripod 50, the placement of the device is, again, either performed by the pizzeria staff, or by the tripod manufacturer.

The device is inexpensive and is typically discarded with the box or, in the case of the tripod, it is conceivable that the tripod can be recycled.

Although the device is shown as being used in a hinged box, it is also contemplated that a box having a separate tray and lid could be used.

It will be understood that each of the elements described above, or two or more together, also may find a useful application in other types of constructions differing from the types described above.

While the invention has been illustrated and described as embodied in a pizza delivery box, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. A moisture-trapping arrangement, comprising:

a) a box having walls bounding an interior for receiving a pizza pie;

b) a support having an elevated platform and a plurality of legs for staking the pizza pie; and c) a moisture-trapping device mounted on the platform and located entirely within the interior of the box, the device including a porous container and a desiccant within the container for absorbing moisture from the pizza pie within the interior of the box.

2. The arrangement of claim 1, wherein the platform has a central opening through which moisture passes en route to the desiccant.

3. The arrangement of claim 1, wherein the device is adhered to the platform.

4. The arrangement of claim 1, wherein the box has a tray with a bottom wall on which the pizza pie is placed, and a cover having a top wall; and wherein the cover is hinged to the tray for movement to a closed position in which the top wall overlies the bottom wall; and wherein the moisture-trapping device and the support are positioned between the bottom and top walls in the closed position.

5. A moisture-trapping device, comprising:

a) a support having an elevated platform having a central opening, and a plurality of legs;

b) a porous container mounted on the platform; and c) a desiccant filling the container for absorbing moisture passing through the central opening.

* * * * *